US009138989B2

(12) United States Patent
Kawatoko et al.

(10) Patent No.: US 9,138,989 B2
(45) Date of Patent: Sep. 22, 2015

(54) PRINTING CONTROL APPARATUS AND PRINTING CONTROL METHOD FOR DISTRIBUTING QUANTIZED IMAGE DATA

(71) Applicant: CANON KABUSHIKI KAISHA, Tokyo (JP)

(72) Inventors: Norihiro Kawatoko, Yokohama (JP); Yutaka Kano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/178,504

(22) Filed: Feb. 12, 2014

(65) Prior Publication Data

US 2014/0232771 A1 Aug. 21, 2014

(30) Foreign Application Priority Data

Feb. 15, 2013 (JP) ..... 2013-028012

(51) Int. Cl.
*B41J 29/38* (2006.01)
*B41J 2/045* (2006.01)
*B41J 2/21* (2006.01)

(52) U.S. Cl.
CPC ..... *B41J 2/04513* (2013.01); *B41J 2/2132* (2013.01)

(58) Field of Classification Search
CPC ..... G06K 15/102; B41J 2/2132
USPC ..... 347/13
See application file for complete search history.

(56) References Cited

U.S. PATENT DOCUMENTS

| | | | | |
|---|---|---|---|---|
| 4,836,527 | A * | 6/1989 | Wong | 271/251 |
| 6,334,659 | B1 | 1/2002 | Maeda et al. | |
| 6,364,446 | B1 | 4/2002 | Ishikawa et al. | |
| 7,261,388 | B2 * | 8/2007 | Vega et al. | 347/13 |
| 7,706,023 | B2 | 4/2010 | Kanda et al. | |
| 8,287,074 | B2 | 10/2012 | Kano et al. | |
| 8,608,271 | B2 | 12/2013 | Murayama et al. | |
| 2007/0070102 | A1 * | 3/2007 | Takata | 347/10 |
| 2010/0118318 | A1 * | 5/2010 | Fuse et al. | 358/1.8 |
| 2010/0245470 | A1 * | 9/2010 | Murayama et al. | 347/37 |
| 2010/0328373 | A1 * | 12/2010 | Langevin et al. | 347/9 |
| 2012/0287193 | A1 | 11/2012 | Suzuki et al. | |
| 2012/0287194 | A1 | 11/2012 | Masuda et al. | |
| 2013/0120769 | A1 * | 5/2013 | Kakutani | 358/1.8 |
| 2014/0104335 | A1 | 4/2014 | Kawatoko et al. | |

FOREIGN PATENT DOCUMENTS

| | | | |
|---|---|---|---|
| EP | 1393910 | A1 * | 3/2004 |
| JP | 2009-220304 | A | 10/2009 |

* cited by examiner

*Primary Examiner* — Shelby Fidler
(74) *Attorney, Agent, or Firm* — Fitzpatrick, Cella, Harper & Scinto

(57) ABSTRACT

In a printing apparatus capable of printing the same pixel by a plurality of print elements, a print speed is increased, and further, a partial frequency of use of each of the print elements is reduced, so as to prolong the lifetime of the print head. In view of this, dithering is used as a pseudo-halftone representing method, and further, a distribution pattern for use in creating image data to be distributed to each of the plurality of print elements is switched.

15 Claims, 19 Drawing Sheets

DITHER MATRIX

| | | | |
|---|---|---|---|
| 0 | 8 | 2 | 10 |
| 12 | 4 | 14 | 6 |
| 3 | 11 | 1 | 9 |
| 15 | 7 | 13 | 5 |

FIG.6A (a) DOT FORMATION POSITION IN CASE OF INPUT VALUE "1"

| | | | | | | | | | | | | | | | |
|---|---|---|---|---|---|---|---|---|---|---|---|---|---|---|---|
| 0 | 8 | 2 | 10 | 0 | 8 | 2 | 10 | 0 | 8 | 2 | 10 | 0 | 8 | 2 | 10 |
| 12 | 4 | 14 | 6 | 12 | 4 | 14 | 6 | 12 | 4 | 14 | 6 | 12 | 4 | 14 | 6 |
| 3 | 11 | 1 | 9 | 3 | 11 | 1 | 9 | 3 | 11 | 1 | 9 | 3 | 11 | 1 | 9 |
| 15 | 7 | 13 | 5 | 15 | 7 | 13 | 5 | 15 | 7 | 13 | 5 | 15 | 7 | 13 | 5 |

N0 N1 N3 N4

(b) POSITIONAL RELATIONSHIP BETWEEN PIXEL AND NOZZLE

R0 R1 R2 R3 ...

L1 L2 L3 L4

L

FIG.6B

DISTRIBUTION PATTERN

PATTERN A PATTERN B PATTERN C PATTERN D

FIG.6C

FIG.10A
{R,G,B}={15,15,15}
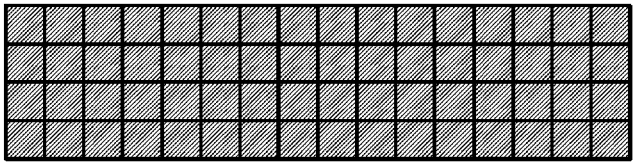
FIG.10B
{C}={1}
| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
FIG.10C
DITHER MATRIX
| | | | |
|---|---|---|---|
| 0 | 8 | 2 | 10 |
| 12 | 4 | 14 | 6 |
| 3 | 11 | 1 | 9 |
| 15 | 7 | 13 | 5 |
FIG.10D
DOT FORMATION POSITION
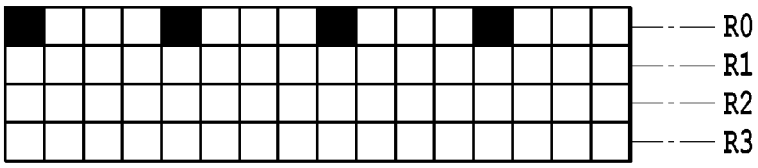
FIG.10E
DISTRIBUTION PATTERN
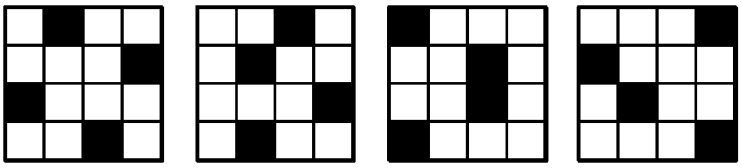
PATTERN A PATTERN B PATTERN C PATTERN D DITHER MATRIX
| | | | | | | | | | | | | | | | |
|---|---|---|---|---|---|---|---|---|---|---|---|---|---|---|---|
| 0 | 8 | 2 | 10 | 15 | 7 | 13 | 5 | 3 | 11 | 1 | 9 | | | | |
| 12 | 4 | 14 | 6 | 0 | 8 | 2 | 10 | 15 | 7 | 13 | 5 | | | | |
| 3 | 11 | 1 | 9 | 12 | 4 | 14 | 6 | 0 | 8 | 2 | 10 | | | | |
| 15 | 7 | 13 | 5 | 3 | 11 | 1 | 9 | 12 | 4 | 14 | 6 | | | | |
| 0 | 8 | 2 | 10 | 15 | 7 | 13 | 5 | 3 | 11 | 1 | 9 | | | | |
| 12 | 4 | 14 | 6 | 0 | 8 | 2 | 10 | 15 | 7 | 13 | 5 | | | | |
| 3 | 11 | 1 | 9 | 12 | 4 | 14 | 6 | 0 | 8 | 2 | 10 | | | | |
| 15 | 7 | 13 | 5 | 3 | 11 | 1 | 9 | 12 | 4 | 14 | 6 | | | | |
| | | | | 15 | 7 | 13 | 5 | 3 | 11 | 1 | 9 | | | | |
| | | | | | | | | 15 | 7 | 13 | 5 | | | | |
FIG.13A
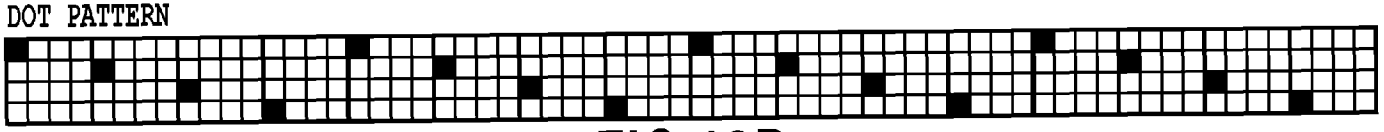
FIG.13B
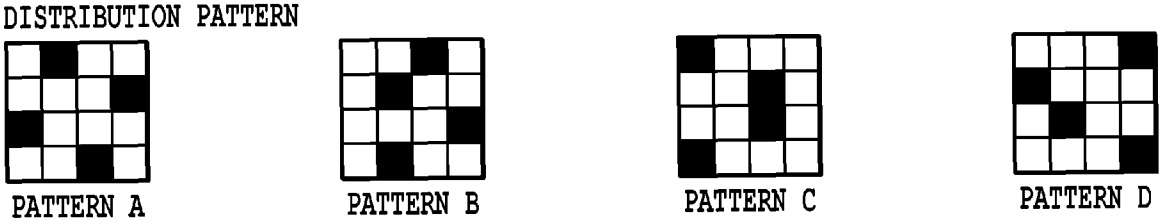
FIG.13C FIG.15A SWITCH TABLE OF DISTRIBUTION PATTERN
NOZZLE ARRAY L1:A A A A B B B B C C C C D D D D
NOZZLE ARRAY L2:B B B B C C C C D D D D A A A A
NOZZLE ARRAY L3:C C C C D D D D A A A A B B B B
NOZZLE ARRAY L4:D D D D A A A A B B B B C C C C
FIG.15B DOT PATTERN FOR EACH OF NOZZLE ARRAYS
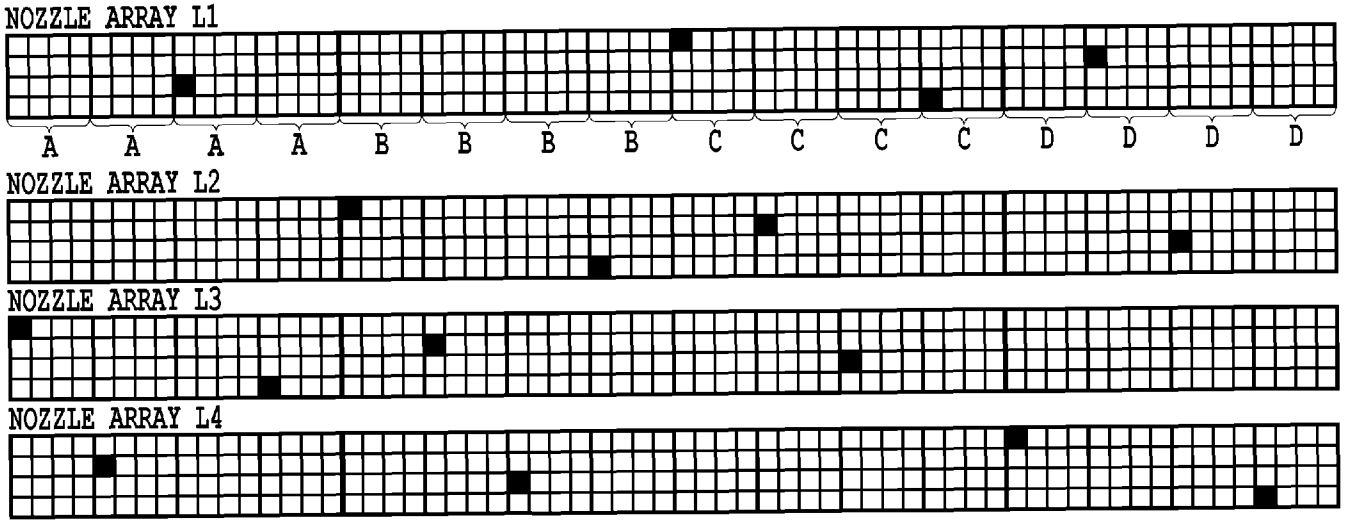
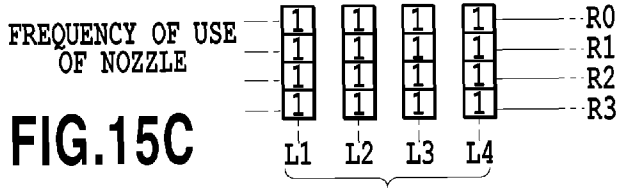
FIG.15C

DOT PATTERN OF DISTRIBUTION RESULT ACCORDING TO DISTRIBUTION PATTERN a (DISTRIBUTION RESULT ACCORDING TO DISTRIBUTION PATTERN A)

b (DISTRIBUTION RESULT ACCORDING TO DISTRIBUTION PATTERN B)

c (DISTRIBUTION RESULT ACCORDING TO DISTRIBUTION PATTERN C)

d (DISTRIBUTION RESULT ACCORDING TO DISTRIBUTION PATTERN D)

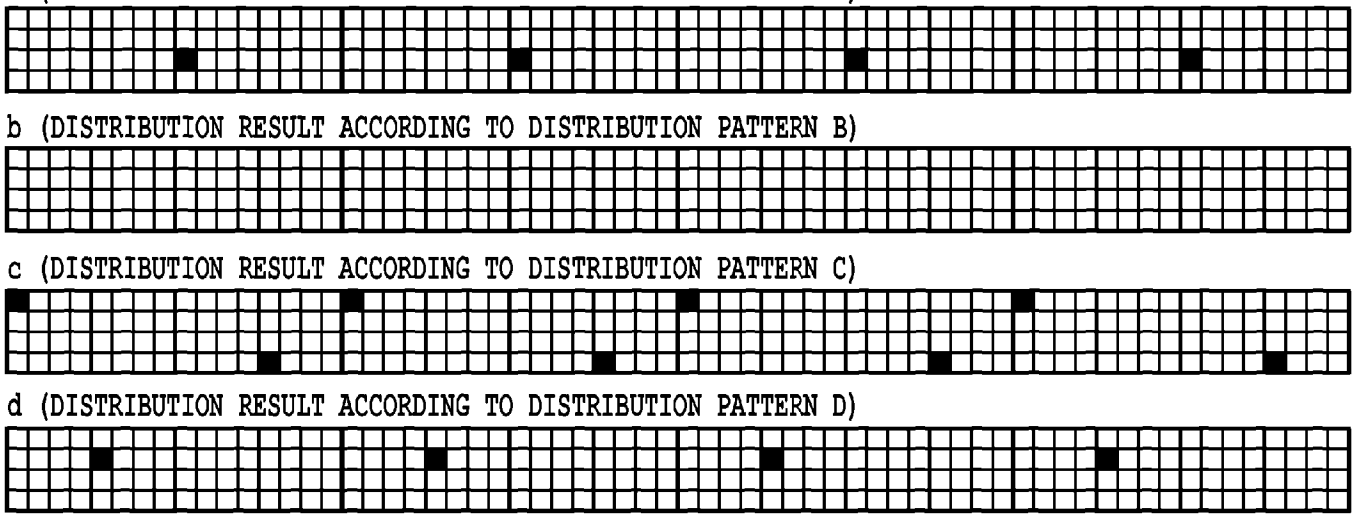

FIG.18A

REPLACEMENT TABLE OF DISTRIBUTION RESULT

| | |
|---|---|
| NOZZLE ARRAY L1 | a a a a b b b b c c c c d d d d |
| NOZZLE ARRAY L2 | b b b b c c c c d d d d a a a a |
| NOZZLE ARRAY L3 | c c c c d d d d a a a a b b b b |
| NOZZLE ARRAY L4 | d d d d a a a a b b b b c c c c |

FIG.18B

PRINTING CONTROL APPARATUS AND PRINTING CONTROL METHOD FOR DISTRIBUTING QUANTIZED IMAGE DATA

BACKGROUND OF THE INVENTION

1. Field of the Invention

The present invention relates to a printing control apparatus of a full line system, in which the same pixel can be printed by the use of a plurality of print elements, and a printing control method.

2. Description of the Related Art

One type of printing apparatus is, for example, an ink jet printing apparatus using an ink jet print head provided with nozzles constituting print elements. Such an ink jet printing apparatus uses an ink jet print head having a plurality of nozzles, which are formed along a nozzle array and can eject ink, for printing an image on a print medium. Such an ink jet printing apparatus is of a serial system or a full line system. In the case of the serial system, an operation for ejecting ink from nozzles while moving a print head in a main scan direction crossing a nozzle array and an operation for conveying a print medium in a sub scan direction crossing the main scan direction are repeated so as to print an image. In contrast, the full line system uses an elongated print head having a nozzle array extending over the entire print area in a width direction of a print medium, and then, sequentially conveys a print medium in a direction crossing the nozzle array while ejecting ink from nozzles of the print head so as to print an image.

The printing apparatus of the serial system adopts a multi-pass print system in which a print head can scan a print area a plurality of times, and then, print an image on a print medium, so as to form ink dots on one line along a main scan direction by using a plurality of nozzles formed at the print head. In this manner, it is possible to suppress deviation (partial) in frequency of use of a nozzle and an influence of variations of ink ejection characteristics of each of nozzles to a low level.

In contrast, since the relationship between the orientation of the nozzle array of the print head and the widthwise position of the print medium is fixed in the printing apparatus of the full line system (i.e., a line printer), a plurality of nozzles cannot form ink dots on one line along the width of the print medium. Consequently, there is a fear of occurrence of the deviation in frequency of use of the nozzle. In particular, in a case where dithering is adopted as a pseudo-halftone representing method, a dither matrix is repeatedly used to print an image, thereby making the deviation in frequency of use of the nozzle conspicuous. On the other hand, in a case where error diffusion is adopted as the pseudo-halftone representing method, an accidental error value is distributed and diffused to a pixel that has not yet processed, and therefore, an output result after the error diffusion cannot have a regular pattern but has a random pattern, thereby reducing the deviation in frequency of use of the nozzle.

However, an error generated in a target pixel is weighted and diffused to peripheral pixels, and therefore, the error diffusion requires much processing time. In view of this, a line printer, for which higher-speed printing is required, adopts dithering as the pseudo-halftone representing method from the viewpoint of a processing speed while requiring the suppression of the deviation in frequency of use of the nozzle to a low level. In the case of the marked deviation in frequency of use of the nozzle, a nozzle of higher frequency of use reaches the end of its lifetime earlier than a nozzle of lower frequency of use, resulting in a short lifetime of the print head.

Japanese Patent Laid-Open No. 2009-220304 proposes a method in which a plurality of print heads extending in a width direction of a print medium are used in a line printer, and then, nozzles of different print heads form adjacent dots on one line in the width direction of the print medium.

However, the technique disclosed in Japanese Patent Laid-Open No. 2009-220304 needs to produce a dot forming pattern per print head in consideration of a constraint of arrangement of dots to be formed by a plurality of print heads in a case where there are a predetermined number or more of dots to be formed adjacently in the width direction of the print medium. In addition, the load of data processing becomes considerably heavy. Particularly, the line printer performs printing at a high speed, and therefore, the need of such processing possibly induces an increase in size of a control circuit or an increase in cost.

Moreover, in a case where the print heads to be used are switched in sequence such that dots formed by the same print head are not continuous in the width direction of the print medium, there may possibly raise a fear of an interference between image data and a switch pattern of the print head to be used. For example, such an interference occurs in a case where four print heads are used to form a dot pattern in the following manner: a one-dot formation position, a one-dot non-formation position, a one-dot non-formation position, and a one-dot non-formation position are sequentially arranged on one line in the width direction of the print medium corresponding to the direction of the nozzle array. In the case of the repetition of the above-described regular dot pattern, variations of ink ejection characteristics of the four print heads more markedly influence a print image than in the case of a random dot pattern.

Additionally, dots may not be sequentially formed in most cases on an image represented with, principally, a halftone, such as a photographic image. In this manner, in a case where there are few dots to be sequentially formed, the plurality of print heads hardly share the load of forming sequential dots in the technique disclosed in Japanese Patent Laid-Open No. 2009-220304. Consequently, a single print head has nozzles of a high frequency of use, thereby raising a fear of impairing prolongation of a lifetime of the print head.

SUMMARY OF THE INVENTION

The present invention provides a printing control apparatus capable of printing the same pixel by a plurality of print elements, in which a print speed is increased, and further, the deviation in frequency of use of each of the print elements is reduced, so as to prolong a lifetime of a print head, and a printing control method.

In the first aspect of the present invention, there is provided a printing control apparatus for controlling a printing apparatus which can print the same pixel by using a plurality of print elements arrayed in a predetermined direction on a print head, the print head and a print medium being movable relatively along the predetermined direction, an unit area on the print medium being printed by one relative moving between the print head and printing medium, the printing control apparatus comprising:

a quantizing unit configured to quantize input image data by dithering;

a distributing unit configured to create image data to be distributed to each of the plurality of print elements from the quantized image data by using a plurality of distribution patterns, the plurality of distribution patterns corresponding to the plurality of print elements and determining a portion to be printed by each of the plurality of print elements, the distribution unit being switchable the distribution patterns to be used such that the portion to be printed by the print element is changed; and a control unit configured to control the print elements based on the image data to be distributed to the print elements.

In the second aspect of the present invention, there is provided a printing control method of controlling a printing apparatus which can print the same pixel by using a plurality of print elements arrayed in a predetermined direction on a print head, the print head and a print medium being movable relatively along the predetermined direction, an unit area on the print medium being printed by one relative moving between the print head and printing medium, the printing control method comprising:

a quantizing step of quantizing input image data by dithering;

a distributing step of creating image data to be distributed to each of the plurality of print elements from the quantized image data by using a plurality of distribution patterns, the plurality of distribution patterns corresponding to the plurality of print elements and determining a portion to be printed by each of the plurality of print elements, the distribution step being switchable the distribution patterns to be used such that the portion to be printed by the print element is changed; and a control step of controlling the print elements based on the image data to be distributed to the print elements.

According to the present invention, in the printing apparatus capable of printing the same pixel by the plurality of print elements, the use of the dithering as a pseudo-halftone representing method can increase the print speed. Moreover, the switch of the distribution pattern for use in producing the image data to be distributed to each of the plurality of print elements can reduce the deviation in frequency of use of each of the print elements so as to prolong the lifetime of the print head.

Further features of the present invention will become apparent from the following description of exemplary embodiments (with reference to the attached drawings).

BRIEF DESCRIPTION OF THE DRAWINGS

FIGS. 6A and 6B are explanatory diagrams illustrating the general dithering and FIG. 6C is an explanatory diagram illustrating distribution patterns;

FIGS. 10A to 10D are explanatory diagrams illustrating image data during processing in the first embodiment according to the present invention and FIG. 10E is an explanatory diagram illustrating distribution patterns;

FIGS. 13A and 13B are explanatory diagrams illustrating a dither matrix in the second embodiment according to the present invention and FIG. 13C is an explanatory diagram illustrating distribution patterns in the second embodiment according to the present invention;

FIGS. 15A to 15C are explanatory diagrams illustrating image data during processing and a processing result in the second embodiment according to the present invention;

FIGS. 18A and 18B are explanatory diagrams illustrating image data during processing in the fifth embodiment according to the present invention.

DESCRIPTION OF THE EMBODIMENTS

Exemplary embodiments according to the present invention will be described below with reference to the attached drawings. First, explanation will be made on the outlines of a printing apparatus of a full line system (i.e., a line printer), a print head, general dithering, a general error diffusion method, and the comparison of the general dithering and general error diffusion.

(Outline of Printing Apparatus)

Figure 1:
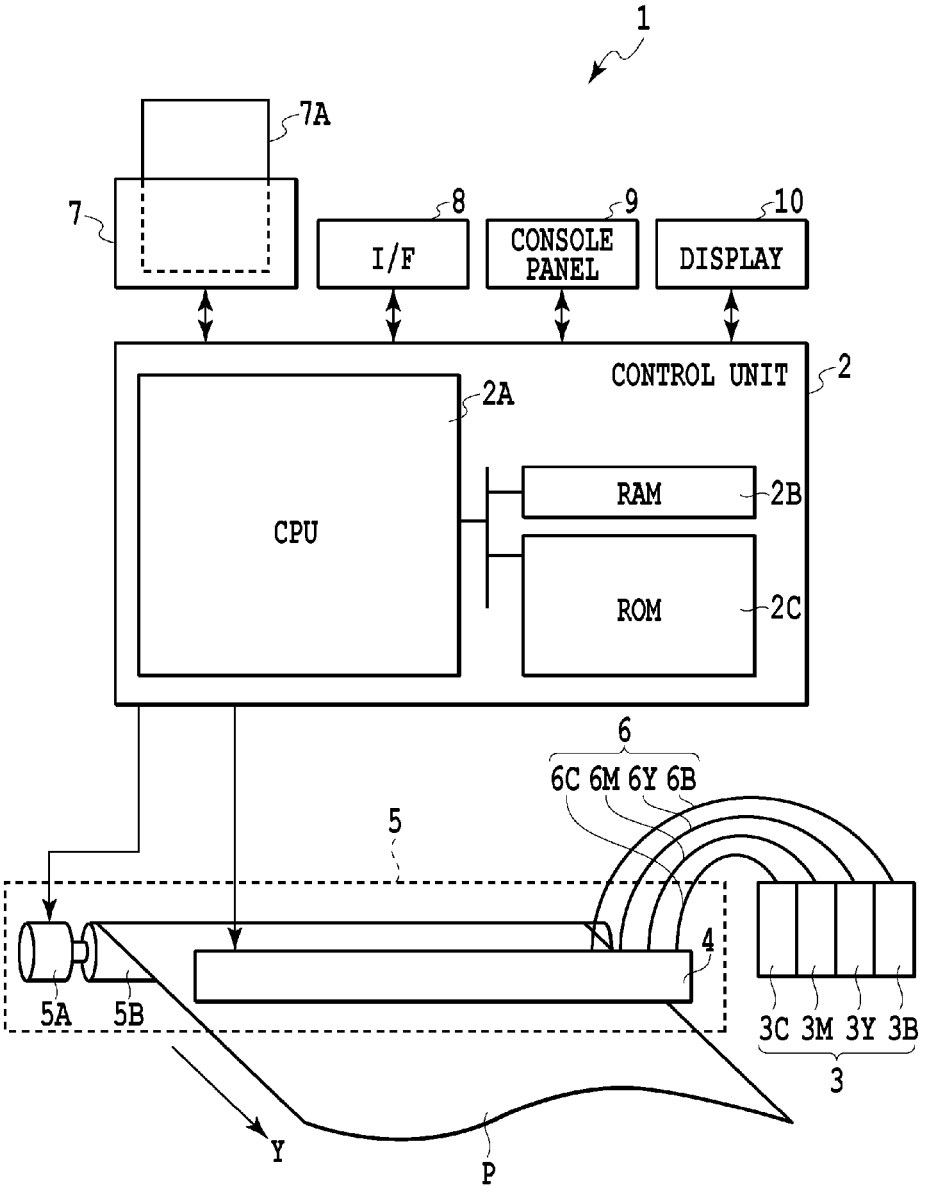
FIG. 1 is a block diagram illustrating a printing apparatus, to which the present invention is applicable.

FIG. 1 is an explanatory diagram illustrating the schematic configuration of a printing apparatus 1 of a full line system, to which the present invention is applicable. The printing apparatus 1 in the present embodiment is a line printer of an ink jet type using, as print elements, nozzles capable of ejecting ink and ejection energy generating elements provided corresponding to the nozzles. The printing apparatus 1 is provided with a control unit 2, ink cartridges 3 (3C, 3M, 3Y, and 3B), print heads 4, a conveyance mechanism 5 for a print medium P, and the like. The ink cartridges 3C, 3M, 3Y, and 3B contain cyan (C), magenta (M), yellow (Y), and black (B) inks, respectively.

Each of the print heads 4 is of an elongated line head type that is movable in a predetermined direction relatively to the print medium P. The four print heads 4 are arranged in a manner facing the print medium P. In the present embodiment, the print medium P is conveyed in a conveyance direction indicated by an arrow Y with respect to the print heads 4. The print heads 4 extend in a direction crossing the conveyance direction indicated by the arrow Y (in the present embodiment, in a width direction of the print medium perpendicular to the conveyance direction), and further, are arranged in series in the conveyance direction. The print heads 4 each are provided with a plurality of nozzles capable of ejecting the ink. These nozzles are arrayed in such a manner as to form four nozzle arrays in the width direction of the print medium P. Each of the print heads 4 is provided with ejection energy generating elements corresponding to the nozzles in such a manner as to form arrays corresponding to the nozzle arrays. Each of the print heads 4 in the present embodiment is of a thermal system using an electrothermal transducer (i.e., a heater) as the ejection energy generating element, and thus, can eject the ink from an ejection port formed at the tip of each of the nozzles with thermal energy generated by the electrothermal transducer. Here, the print head 4 may use a piezo element as the ejection energy generating element. The inks reserved in the ink cartridges 3 (3C, 3M, 3Y, and 3B) are supplied to the four print heads 4 through ink introducing tubes 6 (6C, 6M, 6Y, and 6B), and then, are ejected from the nozzles formed at the print heads so as to form dots on the print medium P. The details of each of the print heads 4 will be described later.

The conveyance mechanism 5 for the print medium P is provided with a sheet feed motor 5A and a sheet feed roller 5B. The sheet feed motor 5A rotates the sheet feed roller 5B, and thus, the print medium P is conveyed in the conveyance direction indicated by the arrow Y crossing the nozzle arrays of the print heads 4 past a position at which the print medium P faces the print heads 4.

The control unit 2 is provided with a CPU 2A, a RAM 2B, and a ROM 2C, and further, controls the print heads and the sheet feed motor 5A. The CPU 2A develops a control program stored in the ROM 2C onto the RAM 2B, and then, executes it, thus producing image data by image processing, described later, and controlling the conveyance mechanism 5. Moreover, the control unit 2 includes a reader 7 for reading data stored in a memory card 7A, an interface 8 that can be connected to various kinds of outside equipment, a console panel 9, and a display 10.

(Outline of Print Head)

Figure 2A:
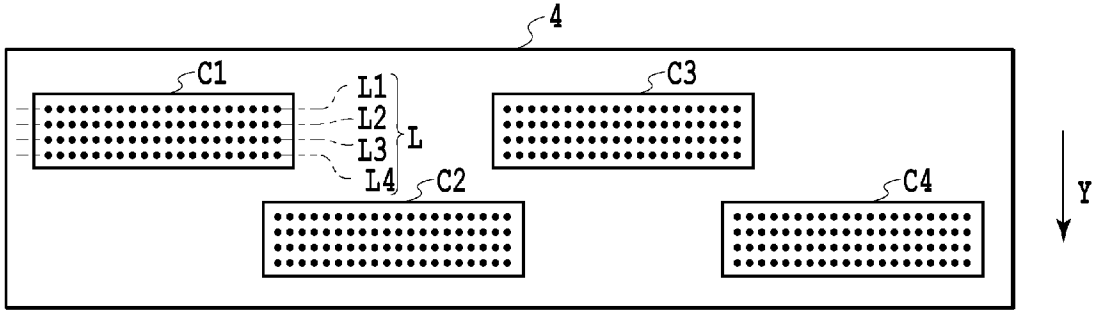
FIGS. 2A and 2B are diagrams schematically illustrating the configuration of a print head illustrated in FIG. 1.

FIG. 2A is a diagram for use in representatively explaining the schematic configuration of one of the four print heads 4 included in the printing apparatus 1. As illustrated in FIG. 2A, four chips C (C1, C2, C3, and C4) are arranged in a zigzag fashion in the print head 4 in the present embodiment. Four nozzle arrays L (L1, L2, L3, and L4), each having nozzles for ejecting the same color ink arrayed thereon, are formed at each of the chips C. The nozzles formed at the ends of the chips adjacent to each other overlap each other in the conveyance direction Y of the print medium. The print head 4 selectively uses the overlapping nozzles, and thus, functions like a single print head having the four nozzle arrays L formed in series thereon.

Figure 2B:
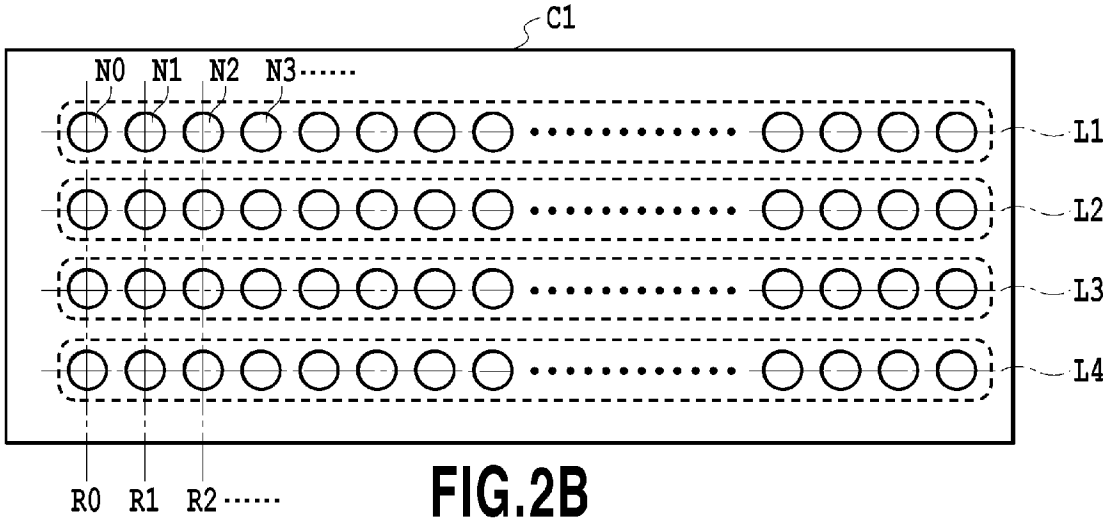

FIG. 2B is a diagram for use in representatively explaining the schematic configuration of the chip C1. 0th nozzles N0 in the four nozzle arrays L (L1, L2, L3, and L4) can form dots with the same color ink on 0th raster R0 in the conveyance direction Y, respectively. Moreover, first nozzles N1 in the four nozzle arrays L can form dots with the same color ink on first raster R1 in the conveyance direction Y, respectively. The same goes for second nozzles N2, third nozzles N3, onwards. In this manner, the nozzles in the four nozzle arrays L can form dots on the same raster with the same color ink. In other words, the print head 4 is provided with the plurality of nozzles capable of ejecting the same color ink such that the nozzles are arrayed in the direction indicated by the arrow Y (i.e., in a direction in which the print head and the print medium are moved relatively to each other), so that the plurality of nozzles can print the same pixel.

The four nozzle arrays can form the dots on the same raster in the present embodiment. However, the number of nozzle arrays is not limited to only four as long as the plurality of nozzle arrays can form the dots on the same raster. Additionally, in the present embodiment, the nozzle arrays extend in the width direction of the print medium perpendicular to the conveyance direction Y, and further, a print resolution in the width direction corresponds to the array density of the nozzles arrayed in the nozzle array. However, the nozzle array may be inclined slantwise in the conveyance direction Y or the plurality of nozzle arrays are arranged a deviating manner from each other, thus increasing the print resolution. As described above, the printing apparatus 1 prints an image on a unit area of the print medium by one relative moving between the print head 1 and the print medium.

(Outline of General Dithering)

Figure 3:
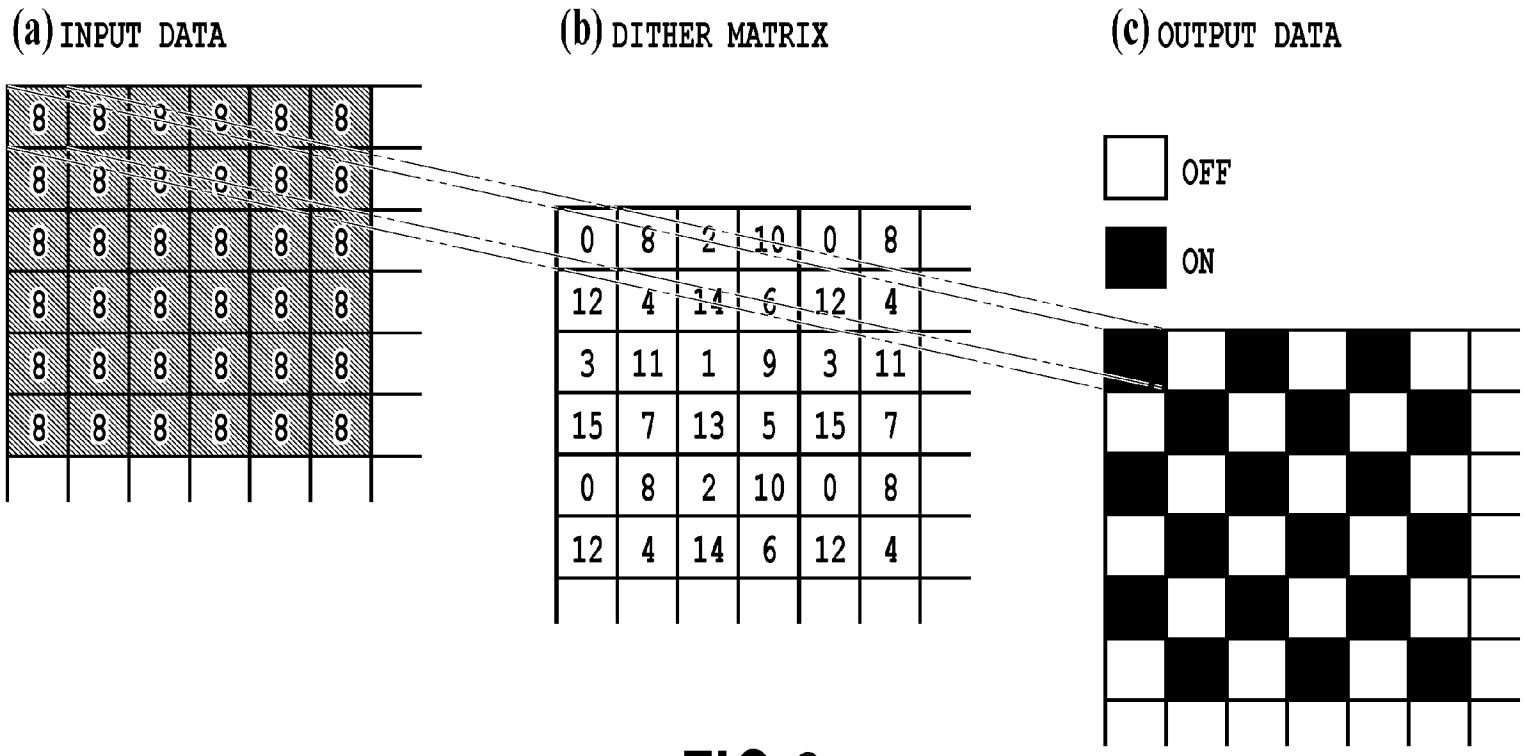
FIG. 3 is an explanatory diagram illustrating general dithering.

In dithering as a halftone representing method, a dither matrix in which different thresholds are arranged within a matrix in a predetermined size (in the present example, a matrix size of 4×4) is prepared, as illustrated in a section (b) in FIG. 3. The dither matrix is sequentially developed on image data illustrated in a section (a) in FIG. 3, and then, multivalued input data (input values) corresponding to the image data is compared with the thresholds arranged inside of the matrix. Thereafter, as illustrated in a section (c) in FIG. 3, in a case where an input value of a target pixel is larger than the threshold, output data becomes ON such that a dot is formed on the target pixel. In contrast, in a case where an input value of a target pixel is equal to or smaller than the threshold, output data becomes OFF such that a dot is not formed on the target pixel. In this manner, a pseudo-halftone image is represented.

As described above, the dithering has an advantage of a high data processing speed because the ON/OFF of the output data is determined based on only the comparison of the input value and the threshold to thus form a dot forming pattern (i.e., a dot pattern) without considering any influence of the target pixel on peripheral pixels. The dot pattern is distributed to the four nozzle arrays L (L1, L2, L3, and L4), described later.

Figure 4:
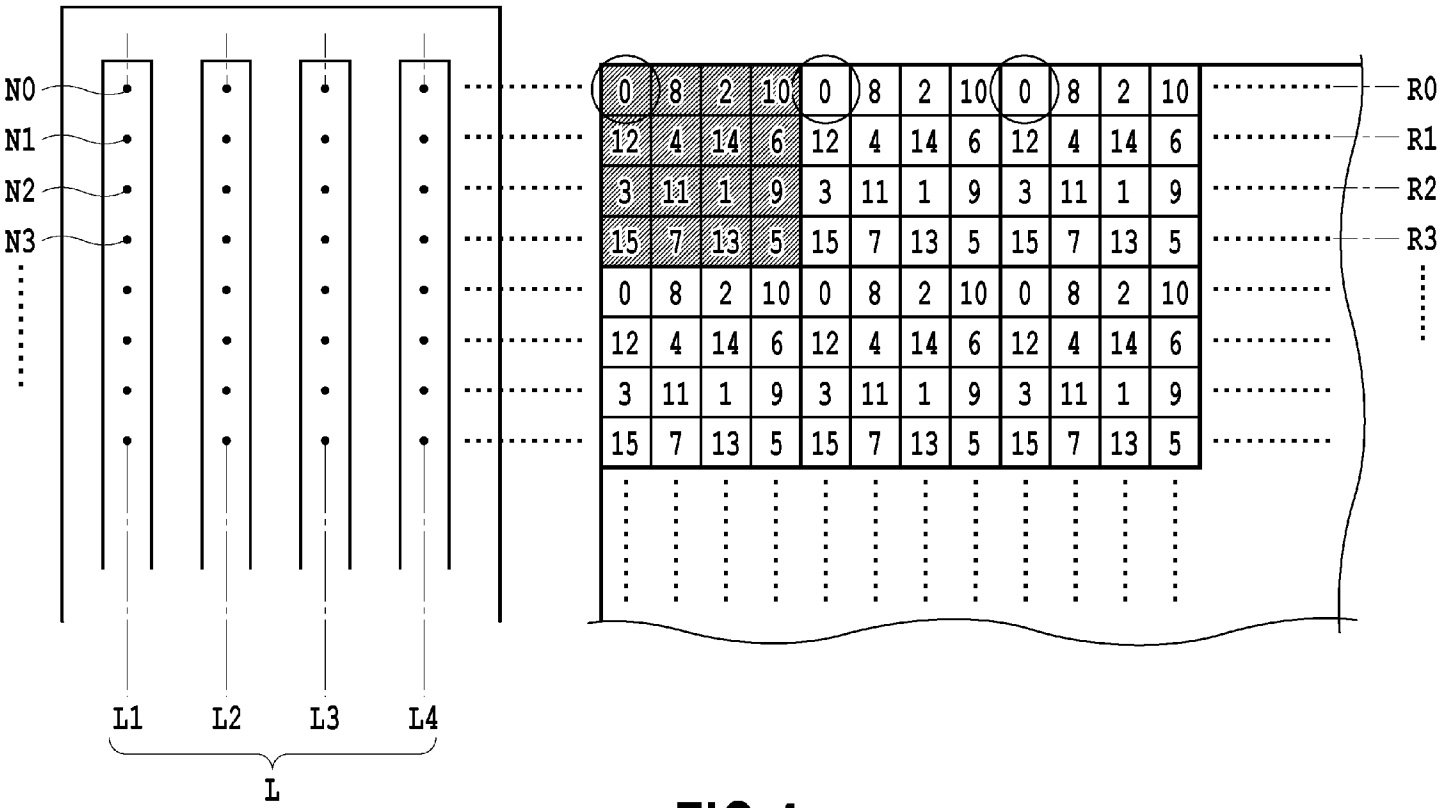
FIG. 4 is an explanatory diagram illustrating the relationship between a dither matrix and a nozzle.
Figure 5:
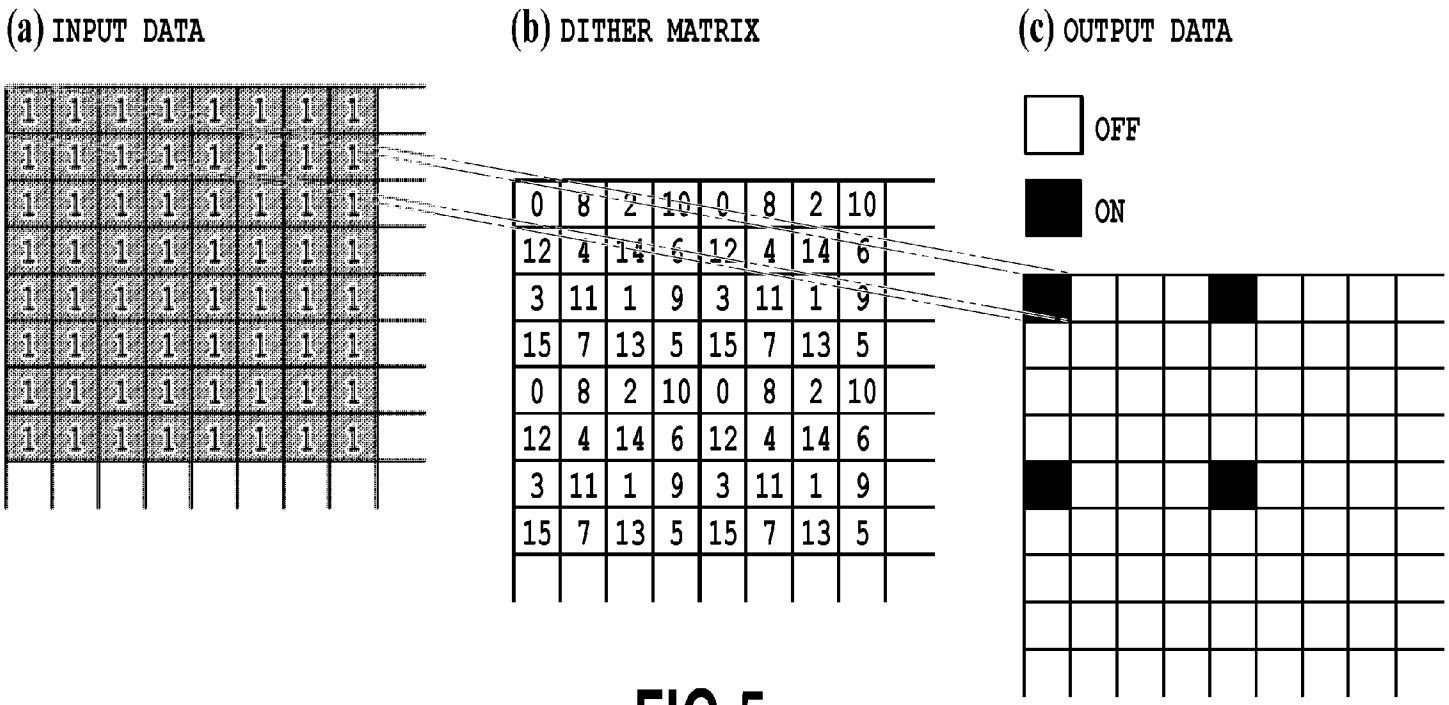
FIG. 5 is an explanatory diagram illustrating the relationship between the dither matrix and input-output data.

On the other hand, since the dither matrix is regularly developed, as illustrated in the section (b) in FIG. 3, there is a fear of deviation (partial) in frequency of use of a nozzle. In other words, in a case where the dither matrix is regularly developed in a tile fashion, as illustrated in FIG. 4, a small threshold (e.g., a threshold "0") and a large threshold (e.g., a threshold "15") are undesirably concentrated on specified rasters R0 and R3, respectively. As for a pixel having a small threshold, corresponding output data becomes ON, and therefore, the probability of formation of a dot becomes high. In contrast, as for a pixel having a large threshold, corresponding output data becomes OFF, and therefore, the probability of formation of a dot becomes low. In this manner, output data which is prone to ON is concentrated on a specified raster, so that the frequency of use of a nozzle used for forming a dot on the specified raster becomes high. For example, in the case of a solid pattern having input data "1" as illustrated in FIG. 5, only output data corresponding to a pixel position at which the dither matrix has a threshold "0" becomes ON.

Next, explanation will be made on a method for distributing output data (i.e., image data) illustrated in the section (c) in FIG. 3 and a section (c) in FIG. 5 to the four nozzle arrays L (L1, L2, L3, and L4).

FIG. 6A illustrates a dither matrix in the present example. FIG. 6B illustrates binarizing a solid pattern having input data "1" with the dither matrix. As illustrated in a section (a) of FIG. 6B, a dot is formed only at an upper left pixel having a threshold "0" in the dither pattern of 4×4. A section (b) of FIG. 6B illustrates the positional relationship between a pixel and a nozzle. In the present example, four nozzles in total in the four nozzle arrays L correspond to the same pixel, as described above. FIG. 6C illustrates distribution patterns for determining which nozzle in the nozzle array L illustrated in the section (b) of FIG. 6B is used to form a dot determined as illustrated in the section (a) of FIG. 6B. The number of distribution patterns to be prepared corresponds to the number of nozzles capable of forming a dot on the same pixel. In the present example, four nozzles can form dots with respect to the same pixel, and therefore, four distribution patterns A, B, C, and D are prepared. The distribution patterns A, B, C, and D correspond to the nozzles in the nozzle arrays L1, L2, L3, and L4, respectively. These four distribution patterns are complementary to each other such that output data corresponding to all pixels become ON in a case where the four distribution patterns are superposed.

Figure 7A:
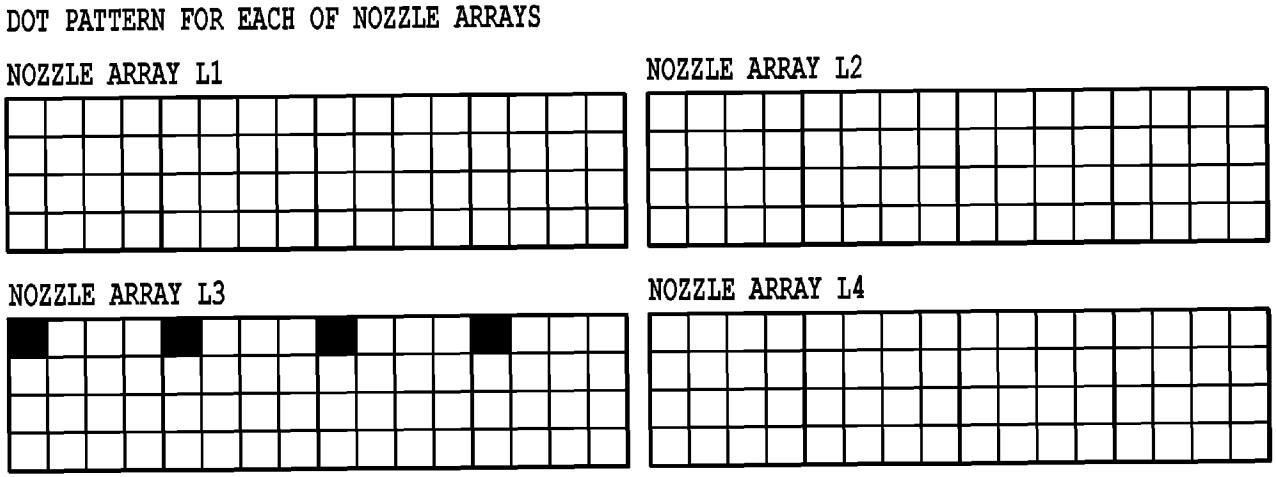
FIGS. 7A and 7B are explanatory diagrams illustrating image data distributed based on the distribution patterns illustrated in FIG. 6C.
Figure 7B:
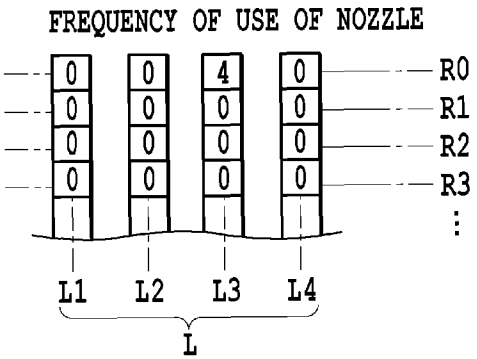

A logical product of the four distribution patterns A, B, C, D and the dot pattern determined as illustrated in the section (a) of FIG. 6B are calculated (ANDed) to determine nozzles for use in forming a dot, as illustrated in FIG. 7A. The dot pattern determined as illustrated in the section (a) of FIG. 6B and the distribution patterns A, B, C, and D are ANDed, so that the dot pattern is determined for each of the nozzle arrays L (L1, L2, L3, and L4) in the case of the solid pattern having the input data "1" as illustrated in FIG. 7A. In the case of the solid pattern having the input data "1", only the output data corresponding to the upper left pixel at the dither pattern of 4×4 becomes ON, as illustrated in the section (a) of FIG. 6B, and therefore, only the nozzle N0 of the nozzle array L3 corresponding to the raster R0 is used according to the distribution pattern C. FIG. 7B is a diagram expressing the frequency of use of the nozzle of each of the nozzle arrays L (L1, L2, L3, and L4) in a case where the dots are formed as illustrated in FIG. 7A. It is found from FIG. 7B that the frequency of use of the nozzle is shifted to only the nozzle array L3. A nozzle having the high frequency of use earlier exhausts its lifetime than other nozzles having the low frequency of use, thereby shortening the lifetime of the print head per se.

(Outline of General Error Diffusion)

Figure 8:
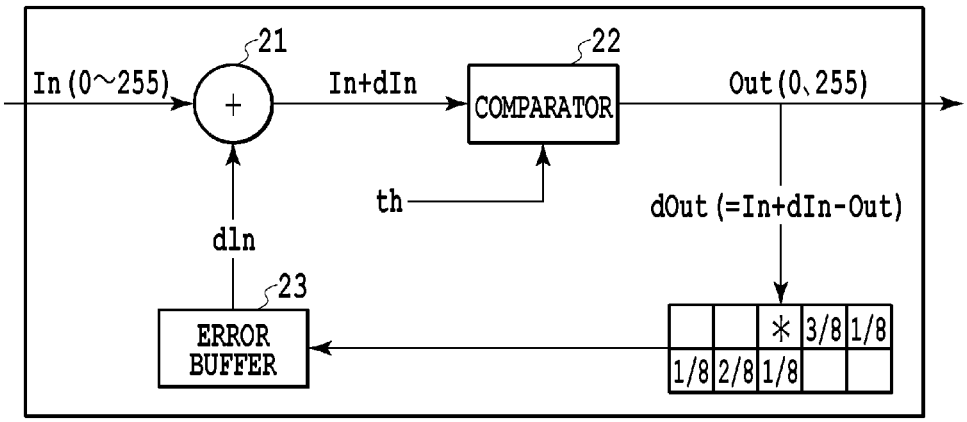
FIG. 8 is a block diagram for use in explaining general error diffusion method.

In error diffusion as the halftone representing method, a block diagram of FIG. 8 may generally illustrate the flow of error diffusion. In the present example, an adder 21 adds a diffusion error (dIn) based on peripheral pixels to an input value (In) corresponding to a target pixel in input data (e.g. data of 8 bits capable of representing one pixel according to a gradation of 0 to 255), thereby obtaining an input correction value (In+dIn). Next, a comparator 22 compares the input correction value (In+dIn) with a threshold (th). In a case where the input correction value (In+dIn) is larger than the threshold (th), an output value (Out) becomes "255" (i.e., dot formation). In contrast, in a case where the input correction value (In+dIn) is equal to or smaller than the threshold (th), the output value (Out) becomes "0" (i.e., dot non-formation). An error value (dOut) produced at this time is obtained from the following equation:

$$dOut=(In+dIn)-Out$$

The error value (dOut) is weighted as a diffusion error with respect to the peripheral pixels, and then, is stored in an error buffer 23. The above-described processing is repeated with respect to all of the pixels of an image. A dot pattern obtained by the above-described error diffusion is not regular, unlike in the above-described dithering, but random. Consequently, the frequency of use of the nozzle is not deviated even in the case of the use of the above-described fixed distribution patterns A, B, C, and D, as illustrated in FIG. 6C. However, it takes more processing time to subject all of the pixels to the above-described error diffusion.

(Comparison Between General Dithering and General Error Diffusion)

The error diffusion is excellent from the viewpoint of the deviation in frequency of use of a nozzle since the deviation in frequency of use of a nozzle becomes is reduced. However, in a case where the error diffusion is adopted in a line printer requiring high-speed printing, there are fears of an increase in size of a processing circuit for the error diffusion and an increase in cost of the processing circuit or the line printer as a whole. In view of this, a method for reducing the deviation in frequency of use of a nozzle is required in addition to the use of the dithering capable of high-speed processing as the halftone representing method.

(First Embodiment)

Subsequently, a description will be given of a first embodiment according to the present invention. The configurations of the printing apparatus and the print head in the present embodiment are similar to those described above.

Figure 9:
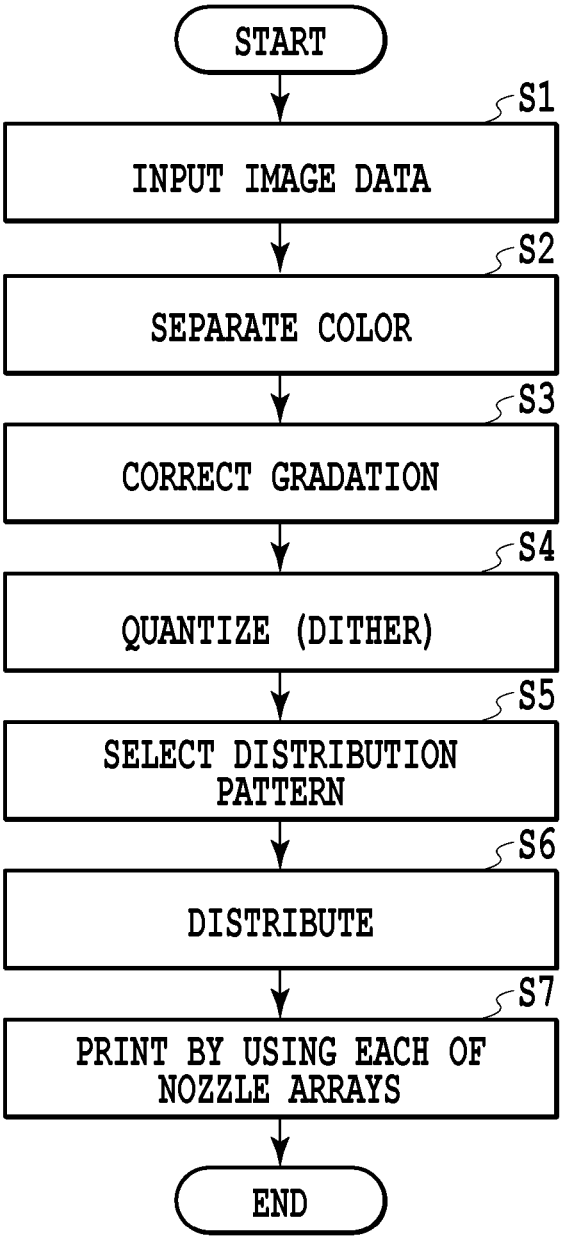
FIG. 9 is a flowchart for use in explaining processing procedures in a first embodiment according to the present invention.

FIG. 9 is a flowchart illustrating a series of processing for determining a dot pattern for each of nozzle arrays L (L1, L2, L3, and L4). First, image data to be printed (e.g., data on a natural image in which each of RGB colors is represented in 8 bits) is input (step S1). Next, the input image data is separated per ink color for use in printing (step S2). As described above, a printing apparatus 1 can print an image with inks of four colors C, M, Y, and K. Therefore, the image data input based on the RGB is converted into gradation value data of the colors C, M, Y, and K according to the color separation in the present embodiment.

And then, a gradation is corrected to eliminate a difference in gradation between the gradation value data per ink color and the density of an actually printed image (step S3). The difference in gradation signifies the inconsistency between the rate of an increase in the number of dots to be formed and the rate of an increase in print density of an image. The reason for the inconsistency between the rates of the increases is that the rate of an increase in print density becomes higher than the rate of an increase in the number of dots to be formed since the size of the dot to be formed is larger than a grating of a print resolution. Gradation correction achieves the adjustment of the rate of an increase in the number of dots to be actually formed with respect to the rate of an increase in gradation data, so that the rate of an increase in gradation data and the rate of an increase in print density become consistent with each other.

Thereafter, the above-described quantizing is performed by the use of dithering as the halftone representing method (step S4). Specifically, the image data (i.e., the input data) whose gradation has been already corrected in step S3 is compared with the threshold on the prepared dither matrix. The output data becomes ON such that a dot is formed only in a case where the image data is greater than the threshold on the dither matrix.

Next, as described later, a distribution pattern for each of the nozzle arrays L is selected (step S5), and then, distributing is performed with the selected distribution pattern (step S6). That is to say, the dot pattern obtained in step S4 and the prepared distribution pattern for each of the nozzle arrays are ANDed, thus determining a nozzle for use in forming a dot. And then, the determined nozzle forms a dot, thus printing an image (step S7).

FIG. 10A illustrates one example of image data to be input in step S1 in FIG. 9. In this example, the image data represents each of RGB in 4 bits. Here, image data represents {R, G, B}={15, 15, 15}. FIG. 10B illustrates one example of image data after the ink colors are separated in step S2 in FIG. 9. Here, only image data corresponding to an ink color C out of the ink colors C, M, Y, and K represents {C}={1}. Explanation on image data whose gradation is corrected in step S3 in FIG. 9 will be omitted. FIG. 10C illustrates a dither matrix of 4×4 to be used in the present embodiment. The image data illustrated in FIG. 10B after the color separation is compared with a dither matrix illustrated in FIG. 10C in step S4 in FIG. 9, thereby determining a dot formation position illustrated in FIG. 10D.

Figure 11A:
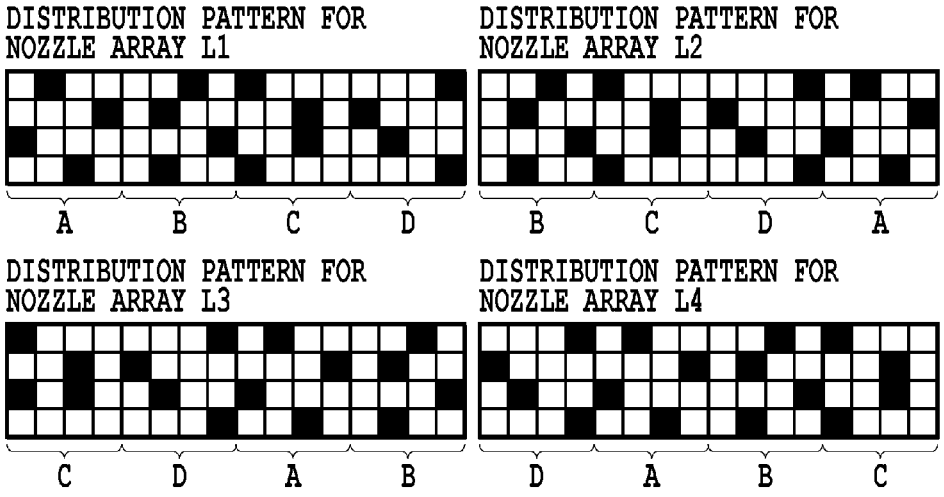
FIGS. 11A to 11C are explanatory diagrams illustrating image data during processing in the first embodiment according to the present invention.

FIG. 10E illustrates distribution patterns selected in step S5 in FIG. 9. The number of distribution patterns corresponds to the number of nozzle arrays capable of forming dots on the same pixel. In the present example, there are prepared four distribution patterns A, B, C, and D corresponding to the four nozzle arrays L (L1, L2, L3, and L4). The distribution pattern for each of the nozzle arrays L is set according to the combination of the four distribution patterns A, B, C, and D, as illustrated in FIG. 11A. In the present example, the distribution patterns for the nozzle array L1 are sequentially switched in order of the distribution patterns A, B, C, and D; the distribution patterns for the nozzle array L2, in order of the distribution patterns B, C, D, and A; the distribution patterns for the nozzle array L3, in order of the distribution patterns C, D, A, and B; and the distribution patterns for the nozzle array L4, in order of the distribution patterns D, A, B, and C.

Figure 11B:
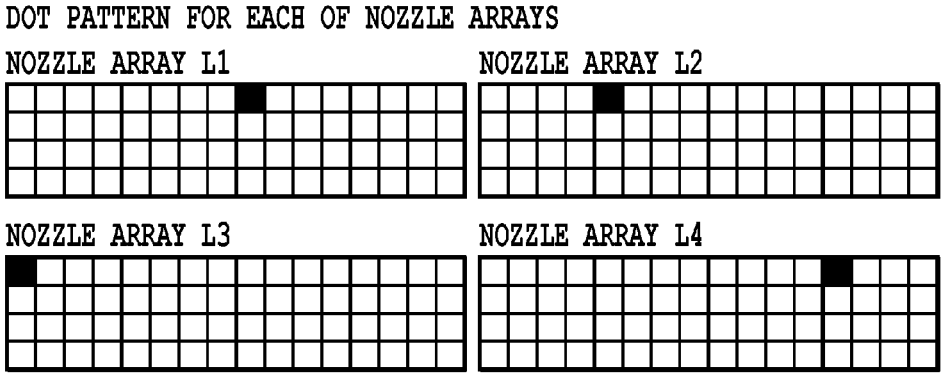

FIG. 11B illustrates the dot patterns in a case where the distribution patterns A, B, C, and D are switchably used, as illustrated in FIG. 11A, that is, the results of the ANDs between the dot patterns illustrated in FIG. 10D and the distribution patterns for the nozzle arrays L. As is obvious from FIG. 11B, it is found that the nozzles to be used are dispersed to the nozzle arrays L1, L2, L3, and L4. In other words, like the present example, the switchable use of the distribution patterns A, B, C, and D of 4×4 illustrated in FIG. 10E can produce the same advantageous result as that in the case of the use of a large distribution pattern of 16×4.

Figure 11C:
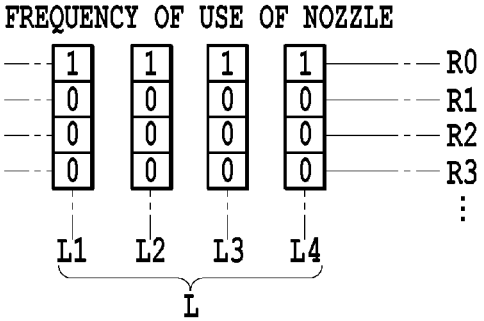

FIG. 11C illustrates the frequency of use of each of the nozzles on the nozzle arrays L (L1, L2, L3, and L4) in a case where the dots are formed, as illustrated in FIG. 11B. It is found that the nozzles to be used are dispersed to the nozzle arrays L1, L2, L3, and L4, so that the use ratio becomes ¼ in comparison with the general dithering illustrated above in FIG. 7B. Specifically, assuming that the lifetime of a nozzle depends upon the number of dots to be formed by the nozzle, the number of dots to be formed by a print nozzle is most used becomes ¼ in a case where continuous printing is performed based on the image data illustrated in FIG. 10A, thus prolonging the lifetime four times.

As described above, the distributing (step S6) in FIG. 9 for determining the nozzle array to be used adopts the simple control for ANDing the prepared distribution patterns and the quantized dot patterns. Such distributing requires no information on the existence of peripheral pixels and the relationship between the dots, thus achieving high-speed processing with a simple configuration. Moreover, the dot patterns for the nozzle arrays can depend upon the combination of the plurality of distribution patterns, thus producing an advantage in substantially preventing an interference of the image data with the distribution patterns, wherein such an interference has been the technical problem to be solved disclosed in Japanese Patent Laid-Open No. 2009-220304.

Additionally, the distribution patterns for the nozzle arrays are changed so as to determine the dot patterns without changing the dot formation position, thus excluding any influence exerted on a print image. Specifically, in a case where the dot formation position is changed in order to equalize the frequency of use of a nozzle, there is apprehension that a change in dot arrangement influences a quality of an image. In contrast, the change of the distribution pattern in the present example can eliminate any influence on a quality of an image.

In this manner, the use of the dithering capable of the high-speed processing and the simple distributing based on the ANDing between the quantized data and the distribution patterns can achieve the deviation in the frequency of use of the nozzle without fixing the nozzle to be used or influencing a print image.

(Second Embodiment)

The present embodiment uses a method for suppressing a difference in frequency of use of a nozzle to a low level by dithering at the same time.

Figure 12:
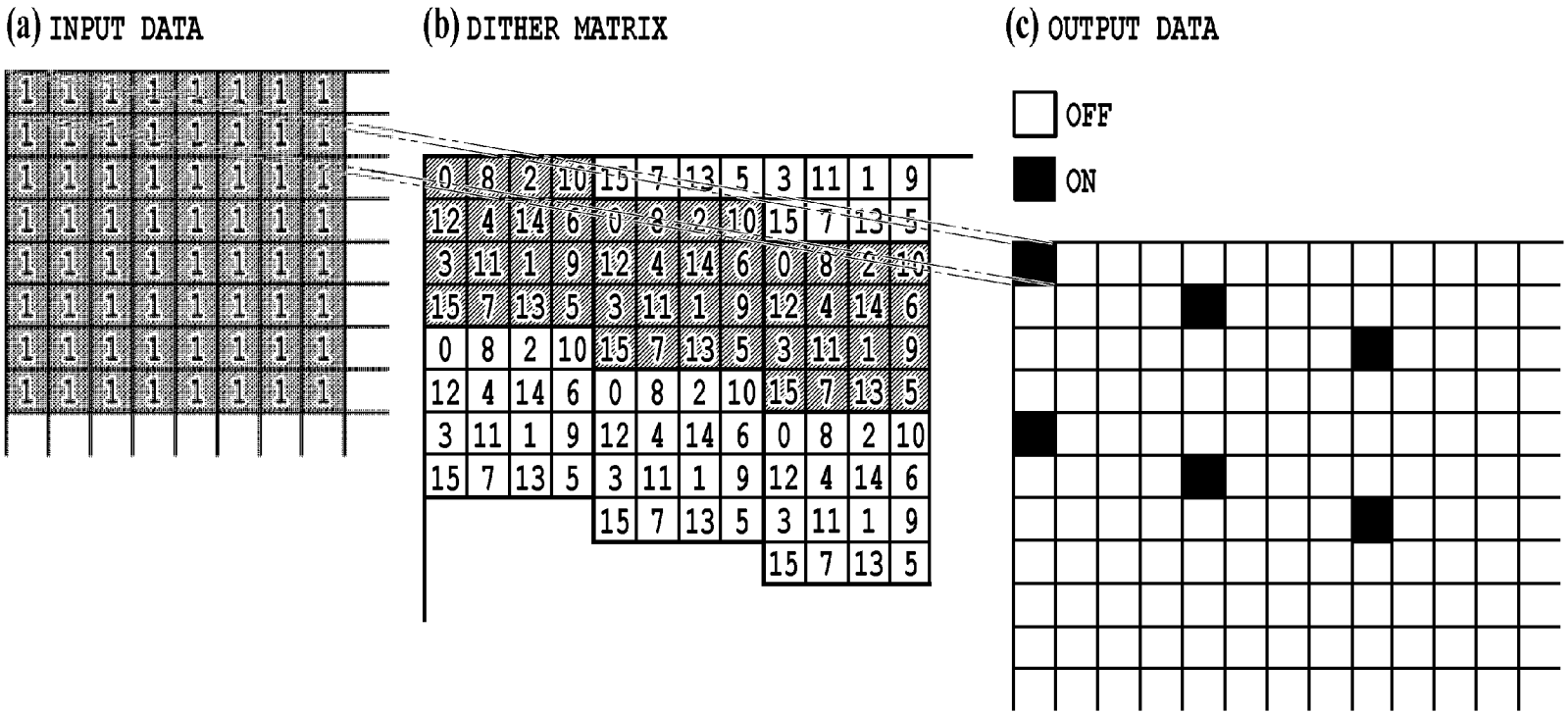
FIG. 12 is an explanatory diagram illustrating the relationship between a dither matrix and input-output data in a second embodiment according to the present invention.

As described above, since the regular patterns are developed in the tile fashion in the general dithering, the frequency of use of the nozzle to be used possibly becomes partial. In order to solve the problem to be solved, the dither matrixes are shifted in a nozzle array direction while being developed, thus preventing the deviation in the frequency of use of a nozzle to be used, as illustrated in FIG. 12. Such a method will be described below.

First, there are prepared dither matrixes having different thresholds arranged in a matrix having a predetermined size (in the present example, a matrix size is 4×4) illustrated in a section (b) of FIG. 12. Next, the dither matrixes are shifted in a nozzle array direction while being developed, as illustrated in a section (b) of FIG. 12, and then, values of multivalued input data (i.e., input values) illustrated in a section (a) of FIG. 12 are compared with the thresholds corresponding thereto. The input data illustrated in the section (a) of FIG. 12 is a solid pattern having an input value of "1". In a case where the input value is larger than or equal to the threshold, output data becomes ON: in contrast, in a case where the input value is smaller than the threshold, the output data becomes OFF, thus representing a pseudo-halftone image. In this manner, the matrixes are shifted while being developed, so that the nozzles to be used can be dispersed without concentration of the nozzles to be used on a specified raster, as illustrated in a section (c) of FIG. 12.

Subsequently, explanation will be made on a dot pattern for each of nozzle arrays L (L1, L2, L3, and L4) in a case where the nozzles to be used are dispersed in the dithering.

Figure 14A:
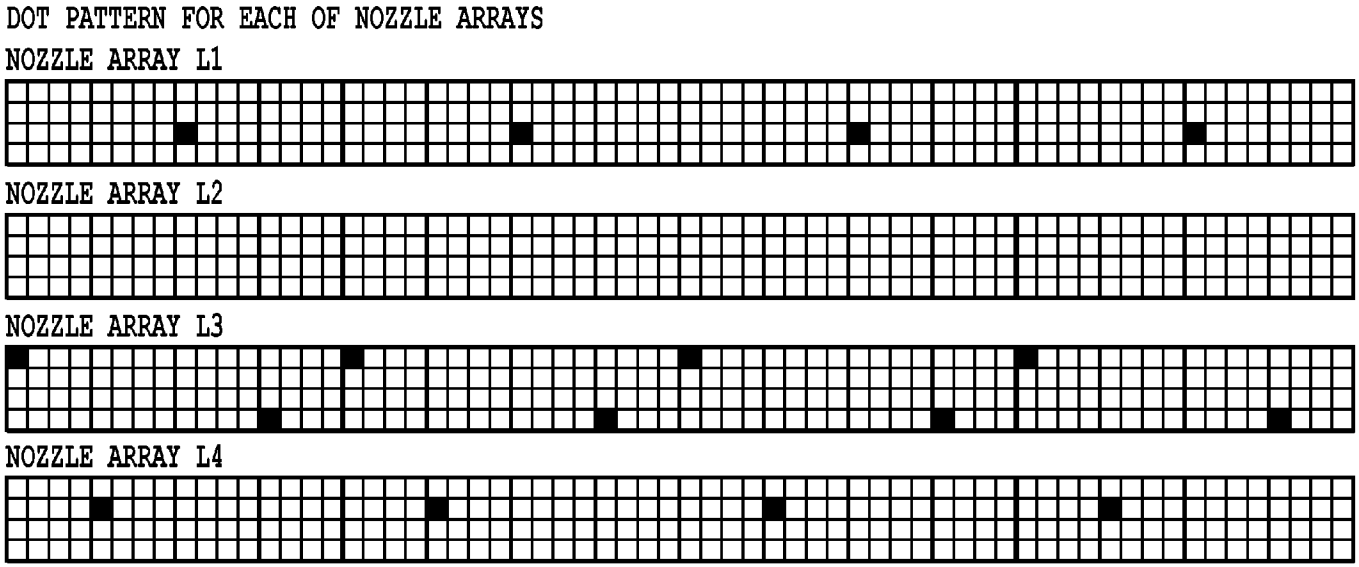
FIGS. 14A and 14B are explanatory diagrams illustrating image data distributed based on the distribution patterns illustrated in FIG. 13C.
Figure 14B:
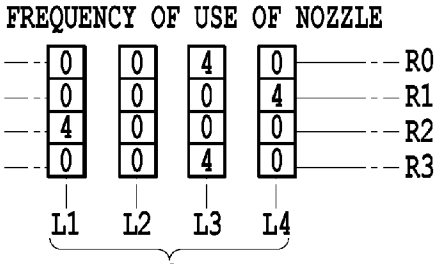

FIG. 13A illustrates a state in which dither matrixes are shifted in a nozzle array direction while being developed, similarly to the section (b) of FIG. 12. The input data on the solid pattern having an input value of "1" illustrated in the section (a) of FIG. 12 is binarized with the dither matrixes developed in the above-described fashion. FIG. 13B illustrates a dot pattern obtained by the binarization. FIG. 13C illustrates a distribution pattern A for the nozzle array L1, a distribution pattern B for the nozzle array L2, a distribution pattern C for the nozzle array L3, and a distribution pattern D for the nozzle array L4. FIG. 14A illustrates a dot pattern for each of the nozzle arrays L (L1, L2, L3, and L4) obtained by ANDing the dot pattern illustrated in FIG. 13B and the distribution patterns illustrated in FIG. 13C. FIG. 14B illustrates results obtained by counting the number of formed dots per raster in each of the nozzle arrays. As is obvious from FIG. 14B, although the dot patterns are dispersed in the nozzle arrays, the frequency of use of the nozzle is "0" or "4" in each of rasters, and namely, it remains partial.

The second embodiment according to the present invention takes the above-described point into consideration, and therefore, performs the following data processing.

FIG. 15A is a switch table for restricting the use order of the distribution patterns A, B, C, and D for the nozzle arrays L (L1, L2, L3, and L4). As for, for example, the nozzle array L1, the distribution patterns to be used are switched in order of A, A, A, A, B, B, B, B, C, C, C, C, D, D, D, and D. The switch cycle of the distribution patterns based on the above-described switch table is set in such a manner as not to accord with the switch cycle of the dither matrixes illustrated in FIG. 13A. In the present example, the switch cycle of the dither matrix is 16 (4×4) pixels whereas the switch cycle of the distribution pattern is 64 (16×4) pixels which are equivalent to the four dither matrixes.

FIG. 15B illustrates dot patterns in a case where the dot patterns illustrated in FIG. 13B are distributed to the nozzle arrays based on the distribution patterns to be switched according to the switch table illustrated in FIG. 15A. FIG. 15C illustrates results obtained by counting the number of formed dots for each of rasters in the nozzle arrays. The count results show the number of dots formed by nozzles in each of the nozzle arrays becomes "1". In comparison with the case illustrated in FIG. 14B, the frequency of use of the nozzle is more equalized. In the case illustrated in FIG. 14B, the maximum number of formed dots is "4": in contrast, it is "1" in the case illustrated in FIG. 15C. Therefore, it is found that the lifetime of a print head is prolonged about four times. In a case where a difference in frequency of use of the nozzle is large, a difference in print characteristics of the nozzles (such as an ink ejection amount, an ejection speed, and a land position onto a print medium) becomes large, thereby inducing a fear of early exhaustion of the print head. Hence, the lifetime of the print head can be further prolonged in the present embodiment.

(Third Embodiment)

In the above-described embodiment, the quantized dot pattern and the fixed distribution pattern are ANDed, so that the dot pattern is distributed to the nozzle array. However, the dot pattern distributing method is not limited to the method described in the above-described embodiment as long as the fixed distribution pattern is used.

A description will be given of a third embodiment in which a different dot pattern distributing method from that in the above-described first embodiment is used.

Figure 16A:
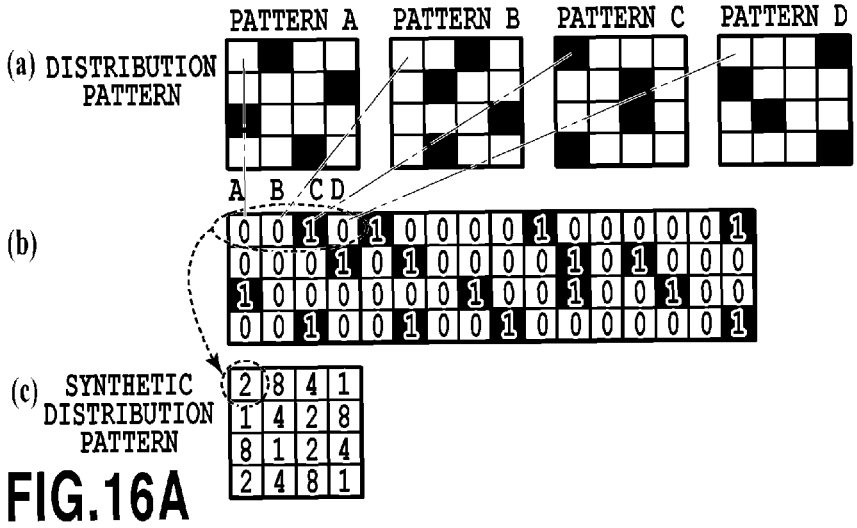
FIGS. 16A to 16C are explanatory diagrams illustrating image data during processing in a third embodiment according to the present invention.

A section (a) of FIG. 16A illustrates distribution patterns A, B, C, and D to be used in the present embodiment. These distribution patterns A, B, C, and D are identical to those used in the first embodiment, and thus, they correspond to nozzles in nozzle arrays L1, L2, L3, and L4, respectively. A synthetic distribution pattern illustrated in a section (c) of FIG. 16A is produced through processing illustrated in a section (b) of FIG. 16A based on the distribution patterns.

Specifically, pattern elements located uppermost and leftmost are extracted out of the distribution patterns A, B, C, and D, thereby producing four pattern elements located uppermost and on the left illustrated in the section (b) of FIG. 16A. At this time, a dot formation unallowable pattern element (i.e., a blank element) at each of the distribution patterns A, B, C, and D is set to "0" whereas a dot formation allowable pattern element (i.e., a black element) is set to "1". In this manner, the four pattern elements located uppermost and on the left illustrated in the section (b) of FIG. 16A show "0010," thus obtaining a binary number in 4 bits. The number in 4 bits is converted into a number represented by the hexadecimal number system, so that a pattern element located uppermost and leftmost is produced in the synthetic distribution pattern illustrated in the section (c) of FIG. 16A. The number "0010" is represented by "2" in the hexadecimal number system. Consequently, it is found that a pixel corresponding to the pattern element "2" at the synthetic distribution pattern illustrated in the section (c) of FIG. 16A is printed with the third nozzle array on the left, that is, the nozzle array L3 corresponding to the distribution pattern C since the number "2" represents the number "0010" in the binary number system.

In the same manner, other pattern elements also are converted into elements in the synthetic distribution pattern illustrated in the section (c) of FIG. 16A. The relationship between pixels and nozzle arrays for use in printing the pixels is established based on the synthetic distribution pattern. For example, a pixel corresponding to the pattern element "8" at the synthetic distribution pattern is printed with the first nozzle array on the left, that is, the nozzle array L1 corresponding to the distribution pattern A since the number "8" represents the number "1000" in the binary number system.

Figure 16B:
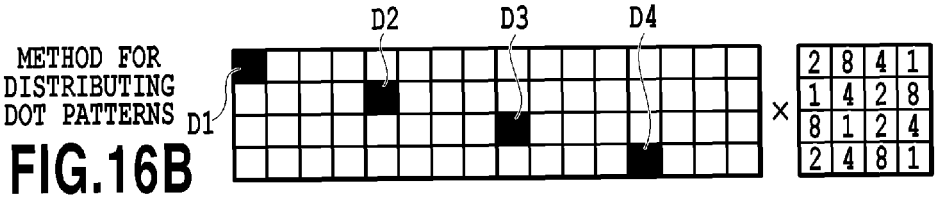
Figure 16C:
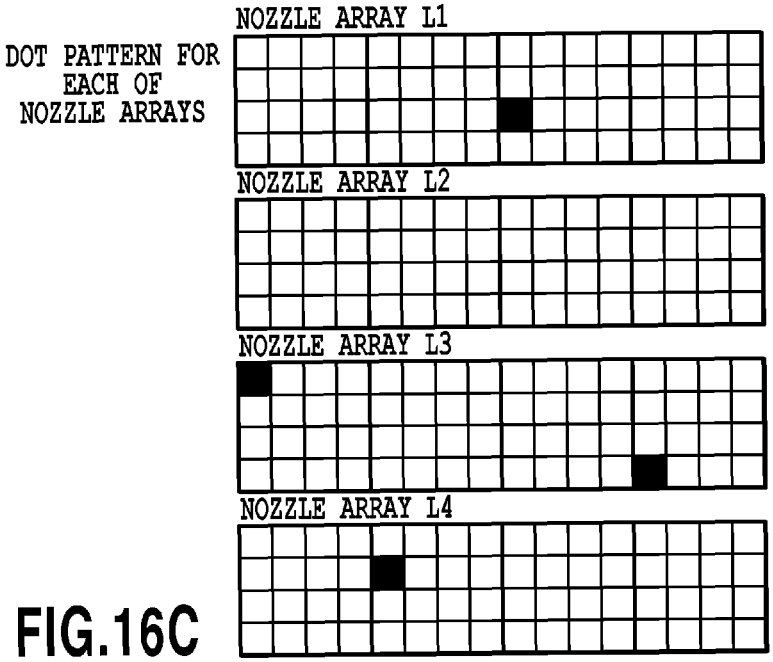

FIG. 16B illustrates a method for distributing the dot patterns illustrated in FIG. 13B to the nozzle arrays L (L1, L2, L3, and L4) with the above-described synthetic distribution pattern. FIG. 16C illustrates dot patterns distributed for the nozzle arrays L, respectively. A dot D1 illustrated in FIG. 16B corresponds to a pixel "2" at the synthetic distribution pattern, and therefore, it is printed by the nozzle array L3. In the same manner, a dot D2 is printed by the nozzle array L4; a dot D3, by the nozzle array L1; and a dot D4, by the nozzle array L3.

In this manner, it is found that the synthetic distribution pattern is created based on the fixed distribution patterns A, B, C, and D, thus producing the same advantageous result as those produced in the above-described first and second embodiments. Thus, it is revealed that the use of the patterns created based on the fixed distribution patterns is effective in distributing the dot pattern to each of the nozzle arrays.

(Fourth Embodiment)

In the second embodiment, the dither matrixes are developed with a shift so as to equalize the frequency of use of the nozzle. However, in a case where the dither matrixes are shifted while being developed, the arrangement of dots is shifted, and therefore, the positions of the dots formed on a print medium are changed, thereby causing concern for an influence on a print image. Although the nozzle array to be used is changed based on the distribution of the dot pattern in the second embodiment, the position of the dot to be formed on the print medium is not changed, so that the dot pattern can be distributed to each of the nozzle arrays without any consideration to an influence on a print image. Consequently, it is also effective to simply switch the distribution pattern illustrated in FIG. 13C during printing an image, and to shift the dither matrix to switch the nozzle to be used during non-printing an image as illustrated in FIG. 13A.

Moreover, the distribution patterns A, B, C, and D are switched within an image, and then, are used in the second embodiment. However, in a case where the switching is cumbersome, the distribution pattern may be switched during the non-printing.

Explanation will be made below on a fourth embodiment according to the present invention in which the distribution pattern is switched per page in the above-described second embodiment.

For example, on a first page, distribution patterns A, B, C, and D are used for nozzle arrays L1, L2, L3, and L4, respectively (L1: the pattern A; L2: the pattern B; L3: the pattern C; and L4: the pattern D). On the next second page, the distribution patterns A, B, C, and D are used for the nozzle arrays L2, L3, L4, and L1, respectively (L2: the pattern A; L3: the pattern B; L4: the pattern C; and L1: the pattern D). On the next third page, the distribution patterns A, B, C, and D are used for the nozzle arrays L3, L4, L1, and L2, respectively (L3: the pattern A; L4: the pattern B; L1: the pattern C; and L2: the pattern D). On the next fourth page, the distribution patterns A, B, C, and D are used for the nozzle arrays L4, L1, L2, and L3, respectively (L4: the pattern A; L1: the pattern B;

L2: the pattern C; and L3: the pattern D). In switching the distribution patterns in the above-described manner, although the frequency of use of the nozzle is partial on each of the pages, the frequency of use of the nozzle is impartial on the plurality of pages as a whole.

The distribution pattern should be desirably switched within an image at any timing, like in the above-described embodiment, as long as the switch timing is a sufficiently shorter time unit than the lifetime of a print head. However, the switch timing may be non-printing timing between pages, job timing, replacement timing of a print medium, a predetermined timing such as a day, a predetermined period of time, a predetermined number of print mediums (a predetermined conveyance distance of a print medium), or the like. Additionally, in a case where the frequency of use of each of the print head or the nozzles is managed, when such a frequency becomes a predetermined value or more, the distribution pattern may be switched. The reason for switching the distribution pattern during the non-printing is that, when the distribution pattern is switched during printing, control in consideration of the switching becomes complicated so as to cause an increase in circuit size or cost. In addition, when the distribution pattern is switched within the image, density unevenness may possibly occur on an image with the low conveyance accuracy of a print medium.

(Fifth Embodiment)

Figure 17:
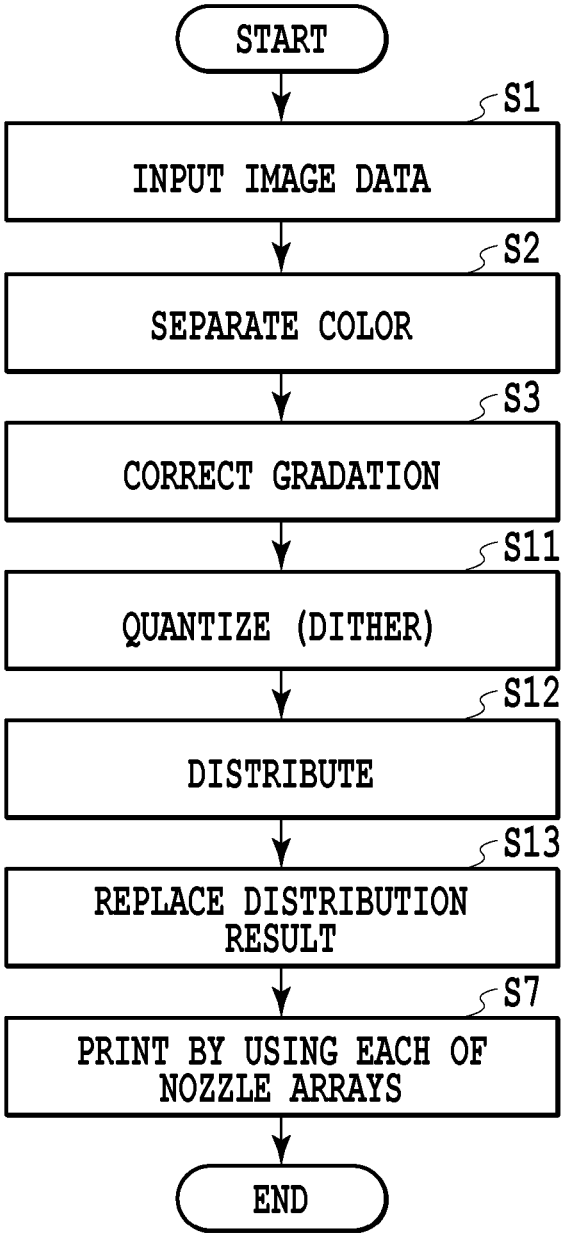
FIG. 17 is a flowchart for use in explaining processing procedures in a fifth embodiment according to the present invention.

Next, a fifth embodiment according to the present invention will be described with reference to FIGS. 17 to 19B. FIG. 17 is a flowchart illustrating a series of processing for determining a dot pattern for each of nozzle arrays L (L1, L2, L3, and L4). FIGS. 18A to 19B illustrate procedures for creating image data in the present embodiment.

Steps S1, S2, S3, and S7 in FIG. 17 are the same as those in FIG. 9 illustrating the above-described embodiment, and therefore, their explanation will be omitted below. In step S11, image data is quantized by using dithering as a halftone representing method. A dither matrix similar to that illustrated above in FIG. 13A is used in the present embodiment. The dither matrix is shifted in a nozzle array direction while being developed in a manner similar to that illustrated in FIG. 12 in the above-described embodiment. With the dither matrix, a solid pattern having input data of "1" is binarized into a dot pattern similar to that illustrated in FIG. 13B in the above-described embodiment.

During distributing in the next step S12, the quantized dot pattern illustrated in FIG. 13B is divided into four patterns corresponding to the number of nozzle arrays L (L1, L2, L3, and L4), like dot patterns a, b, c, and d illustrated in FIG. 18A, by using the distribution patterns A, B, C, and D illustrated in FIG. 13C. Specifically, the dot patterns a, b, c, and d resulting from the distribution are based on the ANDs between the dot patterns illustrated in FIG. 13B and the distribution patterns A, B, C, and D.

Figure 19A:
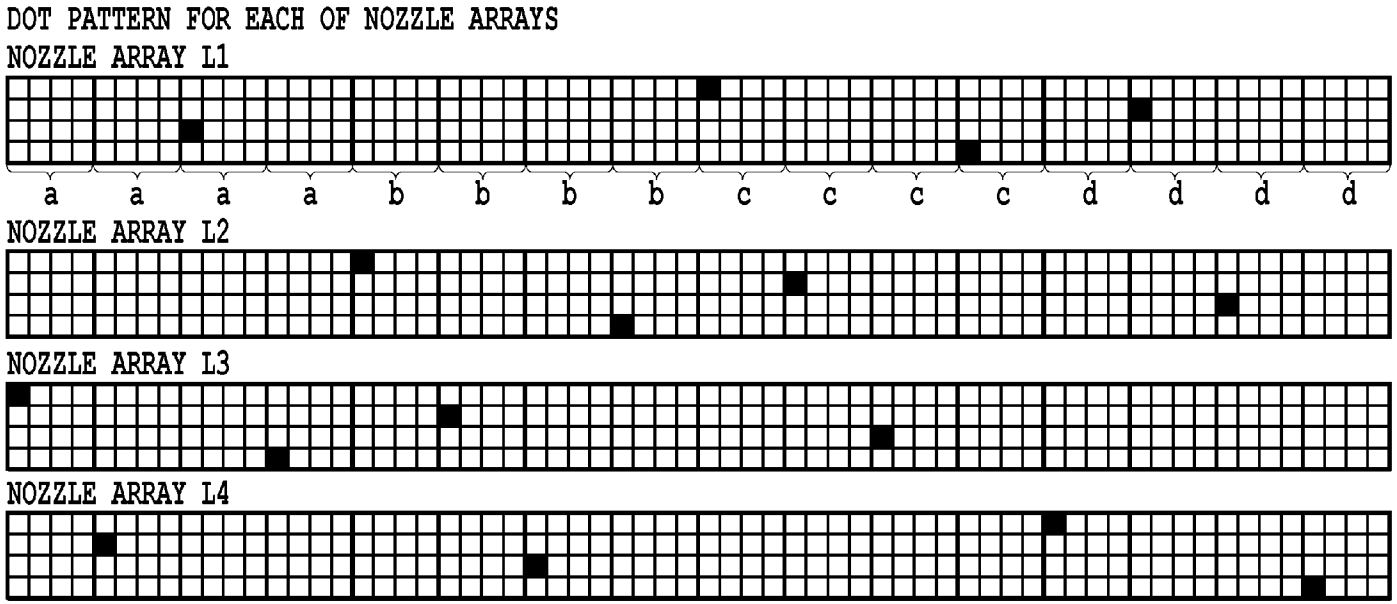
FIGS. 19A and 19B are explanatory diagrams illustrating image data during processing in the fifth embodiment according to the present invention.

During replacing in the next step S13, the distribution results (i.e., the dot patterns a, b, c, and d) assigned to each of the nozzle arrays L (L1, L2, L3, and L4) are replaced in accordance with a replacement table illustrated in FIG. 18B. The replacement table shows aaaabbbbccccdddd regarding the nozzle array L1, and therefore, the dot patterns a, b, c, and d illustrated in FIG. 19A are assigned to the nozzle array L1. Specifically, four units of the dot pattern a, each having a pattern size of 4×4, are first assigned to the nozzle array L1. Next, four units of the dot pattern b, four units of the dot pattern c, and four units of dot pattern d are assigned to the nozzle array L1. As for the nozzle array L2, four units of the dot patterns b, c, d, and a in order are assigned to the nozzle array L2. In the same manner, as for the nozzle array L3, four units of the dot patterns c, d, a, and b in order are assigned, and further, as for the nozzle array L4, four units of the dot patterns d, a, b, and c in order are assigned.

Such a replacing process includes, for example, a method using a memory for temporarily storing image data on each of the nozzle arrays L (L1, L2, L3, and L4). Specifically, the dot patterns a, b, c, and d illustrated in FIG. 18A are stored in the memory while switching where in the memory the dot patterns are written in accordance with the replacement table illustrated in FIG. 18B. In this case, the dot pattern for each of the nozzle arrays L (L1, L2, L3, and L4) illustrated in FIG. 19A is stored in the memory. In another replacing method, in a case where an image is printed with each of the nozzle arrays, the reading positions of the dot patterns illustrated in FIG. 18A may be changed according to the replacement table illustrated in FIG. 18B. In this case, the dot patterns illustrated in FIG. 18A are stored in the memory, and then, an image is printed based on the read data of the dot patterns while varying the reading position of the dot pattern.

Figure 19B:
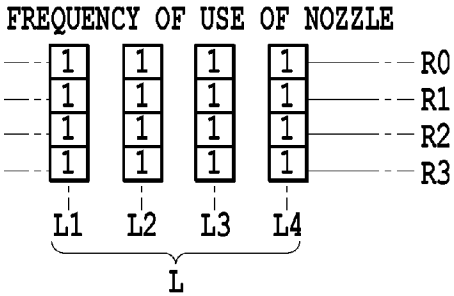

FIG. 19B illustrates the count results of the number of dots formed in each of rasters in the nozzle arrays. It is found from the count results that the frequency of use of the nozzle can be equalized, like in the above-described embodiment.

In the above-described second embodiment, the distribution pattern is switched and used as illustrated in FIG. 15A. Here, the switch of the distribution pattern within the image may possibly arouse a fear of induction of an increase in data processing amount. In a case where a large distribution pattern (a pattern including the distribution patterns A, B, C, and D illustrated in FIG. 15A) including the switch contents are to be stored in advance in order to suppress an increase in processing amount due to such switching, the memory amount to be required becomes extremely large. For example, in a case where the patterns illustrated in FIG. 15B (including the distribution patterns A, B, C, and D illustrated in FIG. 15A and the switch contents) are stored, the memory amount to be required becomes 16 times in comparison with a case where the distribution patterns A, B, C, and D are singly stored as illustrated in FIG. 15A. Like in the present embodiment, the dot patterns are distributed by using the fixed distribution pattern, and further, the nozzle arrays are changed to print the distributed dot pattern at a small processing load. As the distribution pattern remains small, the memory amount to be required is enough to be small.

(Other Embodiments)

In the above-described embodiments, the replacement tables illustrated in FIGS. 15A and 18B have one kind of switch pattern and one kind of switch timing. However, the frequency of use of the nozzle is varied according to the mode of the print head and the position of the nozzle within the print head. Consequently, the switch pattern and the switch timing can be varied among a plurality of print heads and among the nozzles within the print head. For example, the nozzle for ejecting the B ink has the lower frequency of use with respect to a photographic image than the nozzles for ejecting the C, M, and Y inks having the higher frequency of use. Therefore, the switch frequency of the switch table of the nozzle for ejecting the B ink may be lowered or the switch table may be switched only during the non-printing. In this manner, the switch frequency is lowered, thus reducing a data processing load in a printing apparatus.

Additionally, some of the nozzles may have the low frequency of use within one print head. For example, since the nozzles of the chips C1 and C2 illustrated in FIG. 2A overlap at the connecting portion of the chips C1 and C2, the frequency of use of the nozzles becomes low. Thus, as for the nozzles located at the connecting portion, the switch frequency of the switch table may be lowered, or the switch table may be switched only during the non-printing. A density unevenness is liable to occur on an image printed by the nozzles at the connecting portion. In order to suppress the occurrence of the density unevenness, lowering the switch frequency or changing the switch timing is effective in fixing the assignment of the distribution pattern to each of the nozzle arrays.

Moreover, the print head is not limited only to an ink jet print head provided with nozzles capable of ejecting the ink as a print element but it may be a print head of a thermal transfer system and the like.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-028012, filed Feb. 15, 2013, which is hereby incorporated by reference herein in its entirety.

What is claimed is:

1. A printing control apparatus for controlling a printing apparatus which can print the same pixel by using a plurality of print elements arrayed in a predetermined direction on a print head, the plurality of print elements being arranged in different print element arrays extending in a direction crossing the predetermined direction, relative movement between the print head and a print medium being effected along the predetermined direction, a unit area on the print medium being printed by one relative movement between the print head and printing medium, the printing control apparatus comprising:

a quantizing unit configured to quantize input image data by dithering;

a distributing unit configured to create image data to be distributed to each of the plurality of print elements from the quantized image data by using a plurality of distribution patterns which have a complementary relation to each other, the plurality of distribution patterns corresponding to the plurality of print elements and determining a portion to be printed by each of the plurality of print elements, the distributing unit being able to switch, in a moving period corresponding to the one relative movement, a correspondence relation between the plurality of print elements and the plurality of distribution patterns, the number of which is the same as that of the plurality of print elements, while keeping the complementary relation between the plurality of distribution patterns; and a control unit configured to control the print elements based on the image data to be distributed to the print elements.

2. The printing control apparatus according to claim 1, wherein the distributing unit creates the image data to be distributed from the quantized image data by using the distribution patterns, and switches the distribution patterns at the time of the creation of the image data to be distributed.

3. The printing control apparatus according to claim 1, wherein the distributing unit creates a plurality of divided image data from the quantized image data by using the plurality of distribution patterns, and changes a combination of the plurality of divided image data to create the image data to be distributed.

4. The printing control apparatus according to claim 1, wherein the quantizing unit shifts a dither matrix during non-printing.

5. The printing control apparatus according to claim 1, wherein the distributing unit switches the distribution patterns during printing.

6. The printing control apparatus according to claim 1, wherein the distributing unit switches the distribution patterns during non-printing.

7. The printing control apparatus according to claim 1, wherein the distributing unit can change a frequency of switching of the distribution patterns.

8. The printing control apparatus according to claim 1, wherein the distributing unit changes the frequency of switching of the distribution patterns according to a position of the print elements in the print head.

9. The printing control apparatus according to claim 1, wherein the plurality of print elements are arranged in different print element arrays extending in a direction crossing the predetermined direction.

10. The printing control apparatus according to claim 1, wherein each of the print elements includes a nozzle capable of ejecting ink.

11. The printing control apparatus according to claim 1, wherein the printing apparatus comprises a conveying unit configured to convey the print medium in the predetermined direction.

12. The printing control apparatus according to claim 1, wherein the distributing unit can cyclically switch the correspondence relation between the plurality of print elements and the plurality of distribution patterns.

13. The printing control apparatus according to claim 1, wherein the distributing unit switches the correspondence relation during the relative movement.

14. The printing control apparatus according to claim 1, wherein the numbers of the plurality of print elements and of the plurality of distribution patterns is each at least three.

15. A printing control method of controlling a printing apparatus which can print the same pixel by using a plurality of print elements arrayed in a predetermined direction on a print head, the plurality of print elements being arranged in different print element arrays extending in a direction crossing the predetermined direction, relative movement between the print head and a print medium being effected along the predetermined direction, a unit area on the print medium being printed by one relative movement between the print head and printing medium, the printing control method comprising:

a quantizing step of quantizing input image data by dithering;

a distributing step of creating image data to be distributed to each of the plurality of print elements from the quantized image data by using a plurality of distribution patterns which have a complementary relation to each other, the plurality of distribution patterns corresponding to the plurality of print elements and determining a portion to be printed by each of the plurality of print elements, the distributing step being able to switch, in a moving period corresponding to the one relative movement, a correspondence relation between the plurality of print elements and the plurality of distribution patterns, the number of which is the same as that of the plurality of print elements, while keeping the complementary relation between the plurality of distribution patterns; and a control step of controlling the print elements based on the image data to be distributed to the print elements.

* * * * *